US011652307B2

(12) United States Patent
Yue

(10) Patent No.: US 11,652,307 B2
(45) Date of Patent: May 16, 2023

(54) HIGH SPEED CONNECTOR

(71) Applicant: AMPHENOL EAST ASIA ELECTRONIC TECHNOLOGY (SHEN ZHEN) CO., LTD., Shen Zhen (CN)

(72) Inventor: Yu Yue, Shen Zhen (CN)

(73) Assignee: Amphenol East Asia Electronic Technology (Shenzhen) Co., Ltd., Shenzhen (CN)

( * ) Notice: Subject to any disclaimer, the term of this patent is extended or adjusted under 35 U.S.C. 154(b) by 0 days.

(21) Appl. No.: 16/998,845

(22) Filed: Aug. 20, 2020

(65) Prior Publication Data

US 2022/0059954 A1 Feb. 24, 2022

(51) Int. Cl.

| | |
|---|---|
| ***H01R 12/63*** | (2011.01) |
| ***H01R 24/60*** | (2011.01) |
| ***H01R 13/502*** | (2006.01) |

(52) U.S. Cl.

CPC ..... *H01R 12/63* (2013.01); *H01R 13/502* (2013.01); *H01R 24/60* (2013.01)

(58) Field of Classification Search

CPC ..... H01R 12/63; H01R 13/502; H01R 24/60
USPC ..... 439/676
See application file for complete search history.

(56) References Cited

U.S. PATENT DOCUMENTS

| | | | |
|---|---|---|---|
| 2,996,710 | A | 8/1961 | Pratt |
| 3,002,162 | A | 9/1961 | Garstang |
| 3,134,950 | A | 5/1964 | Cook |
| 3,322,885 | A | 5/1967 | May et al. |
| 3,530,422 | A | 9/1970 | Goodman |
| 3,631,381 | A | 12/1971 | Pittman |
| 3,786,372 | A | 1/1974 | Epis et al. |
| 3,825,874 | A | 7/1974 | Peverill |
| 3,863,181 | A | 1/1975 | Glance et al. |

(Continued)

FOREIGN PATENT DOCUMENTS

| | | | |
|---|---|---|---|
| CN | 1175101 | A | 3/1998 |
| CN | 1192068 | A | 9/1998 |

(Continued)

OTHER PUBLICATIONS

U.S. Appl. No. 16/721,594, filed Dec. 19, 2019, Lu.

(Continued)

*Primary Examiner* — Alexander Gilman
(74) *Attorney, Agent, or Firm* — Wolf, Greenfield & Sacks, P.C.

(57) ABSTRACT

A high speed connector includes a metal casing, a plastic casing, and a terminal assembly; the metal casing including a main wall, a side wall, and a combination position; the plastic casing including a front connection portion, an engagement member, a protrusion, and a terminal engagement slot; the main wall including an engagement bore; the side wall disposed on the main wall; the combination portion formed between the main wall and the side wall; the front connection portion and the terminal engagement slot disposed in and on a lateral side of the cover body; the engagement member laterally disposed on the front connection portion; the protrusion disposed on the cover body; when the metal casing being engaged with the plastic casing, the protrusion being engaged in the engagement bore, and the protrusion being engaged in the combination position.

20 Claims, 2 Drawing Sheets

(56) References Cited

U.S. PATENT DOCUMENTS 3,977,757 A * 8/1976 Yurtin ..... H01R 12/592 439/852
4,155,613 A 5/1979 Brandeau
4,195,272 A 3/1980 Boutros
4,276,523 A 6/1981 Boutros et al.
4,286,837 A 9/1981 Yasutake et al.
4,371,742 A 2/1983 Manly
4,408,255 A 10/1983 Adkins
4,447,105 A 5/1984 Ruehl
4,471,015 A 9/1984 Ebneth et al.
4,484,159 A 11/1984 Whitley
4,490,283 A 12/1984 Kleiner
4,518,651 A 5/1985 Wolfe, Jr.
4,519,664 A 5/1985 Tillotson
4,519,665 A 5/1985 Althouse et al.
4,632,476 A 12/1986 Schell
4,636,752 A 1/1987 Saito
4,682,129 A 7/1987 Bakermans et al.
4,687,267 A 8/1987 Header et al.
4,728,762 A 3/1988 Roth et al.
4,751,479 A 6/1988 Parr
4,761,147 A 8/1988 Gauthier
4,787,548 A 11/1988 Abbagnaro et al.
4,806,107 A 2/1989 Arnold et al.
4,846,724 A 7/1989 Sasaki et al.
4,846,727 A 7/1989 Glover et al.
4,871,316 A 10/1989 Herrell et al.
4,878,155 A 10/1989 Conley
4,948,922 A 8/1990 Varadan et al.
4,970,354 A 11/1990 Iwasa et al.
4,975,084 A 12/1990 Fedder et al.
4,992,060 A 2/1991 Meyer
5,000,700 A 3/1991 Masubuchi et al.
5,066,236 A 11/1991 Broeksteeg
5,141,454 A 8/1992 Garrett et al.
5,150,086 A 9/1992 Ito
5,166,527 A 11/1992 Solymar
5,168,252 A 12/1992 Naito
5,168,432 A 12/1992 Murphy et al.
5,171,161 A 12/1992 Kachlic
5,176,538 A 1/1993 Hansell, III et al.
5,266,055 A 11/1993 Naito et al.
5,280,257 A 1/1994 Cravens et al.
5,287,076 A 2/1994 Johnescu et al.
5,334,050 A 8/1994 Andrews
5,340,334 A 8/1994 Nguyen
5,346,410 A 9/1994 Moore, Jr.
5,429,520 A 7/1995 Morlion et al.
5,429,521 A 7/1995 Morlion et al.
5,433,617 A 7/1995 Morlion et al.
5,433,618 A 7/1995 Morlion et al.
5,456,619 A 10/1995 Belopolsky et al.
5,461,392 A 10/1995 Mott et al.
5,474,472 A 12/1995 Niwa et al.
5,484,310 A 1/1996 McNamara et al.
5,496,183 A 3/1996 Soes et al.
5,499,935 A 3/1996 Powell
5,551,893 A 9/1996 Johnson
5,562,497 A 10/1996 Yagi et al.
5,597,328 A 1/1997 Mouissie
5,651,702 A 7/1997 Hanning et al.
5,669,789 A 9/1997 Law
5,796,323 A 8/1998 Uchikoba et al.
5,831,491 A 11/1998 Buer et al.
5,885,088 A 3/1999 Brennan et al.
5,924,899 A 7/1999 Paagman
5,981,869 A 11/1999 Kroger
5,982,253 A 11/1999 Perrin et al.
5,993,259 A 11/1999 Stokoe et al.
6,019,616 A 2/2000 Yagi et al.
6,152,747 A 11/2000 McNamara
6,168,469 B1 1/2001 Lu
6,174,202 B1 1/2001 Mitra
6,174,203 B1 1/2001 Asao
6,174,944 B1 1/2001 Chiba et al.
6,217,372 B1 4/2001 Reed
6,293,827 B1 9/2001 Stokoe
6,296,491 B1 10/2001 Pickles
6,296,496 B1 10/2001 Trammel
6,299,438 B1 10/2001 Sahagian et al.
6,299,483 B1 10/2001 Cohen et al.
6,315,615 B1 11/2001 Raistrick
6,322,395 B1 11/2001 Nishio et al.
6,328,601 B1 12/2001 Yip et al.
6,347,962 B1 2/2002 Kline
6,350,134 B1 2/2002 Fogg et al.
6,361,363 B1 3/2002 Hwang
6,364,711 B1 4/2002 Berg et al.
6,375,510 B2 4/2002 Asao
6,379,188 B1 4/2002 Cohen et al.
6,394,842 B1 5/2002 Sakurai et al.
6,398,588 B1 6/2002 Bickford
6,409,543 B1 6/2002 Astbury, Jr. et al.
6,447,170 B1 9/2002 Takahashi et al.
6,482,017 B1 11/2002 Van Doorn
6,503,103 B1 1/2003 Cohen et al.
6,506,076 B2 1/2003 Cohen et al.
6,517,360 B1 2/2003 Cohen
6,530,790 B1 3/2003 McNamara et al.
6,537,087 B2 3/2003 McNamara et al.
6,540,559 B1 4/2003 Kemmick et al.
6,551,140 B2 4/2003 Billman et al.
6,554,647 B1 4/2003 Cohen et al.
6,565,387 B2 5/2003 Cohen
6,565,390 B2 5/2003 Wu
6,579,116 B2 6/2003 Brennan et al.
6,582,244 B2 6/2003 Fogg et al.
6,592,381 B2 7/2003 Cohen et al.
6,595,801 B1 7/2003 Leonard et al.
6,595,802 B1 7/2003 Watanabe et al.
6,602,095 B2 8/2003 Astbury, Jr. et al.
6,607,402 B2 8/2003 Cohen et al.
6,609,922 B2 8/2003 Torii
6,616,864 B1 9/2003 Jiang et al.
6,652,318 B1 11/2003 Winings et al.
6,652,319 B1 11/2003 Billman
6,655,966 B2 12/2003 Rothermel et al.
6,709,294 B1 3/2004 Cohen et al.
6,713,672 B1 3/2004 Stickney
6,726,492 B1 4/2004 Yu
6,743,057 B2 6/2004 Davis et al.
6,776,659 B1 8/2004 Stokoe et al.
6,786,771 B2 9/2004 Gailus
6,808,420 B2 10/2004 Whiteman, Jr. et al.
6,814,619 B1 11/2004 Stokoe et al.
6,830,489 B2 12/2004 Aoyama
6,872,085 B1 3/2005 Cohen et al.
6,875,031 B1 4/2005 Korsunsky et al.
6,932,649 B1 8/2005 Rothermel et al.
6,979,202 B2 12/2005 Benham et al.
6,979,226 B2 12/2005 Otsu et al.
7,044,794 B2 5/2006 Consoli et al.
7,057,570 B2 6/2006 Irion, II et al.
7,074,086 B2 7/2006 Cohen et al.
7,086,872 B2 8/2006 Myer et al.
7,094,102 B2 8/2006 Cohen et al.
7,104,842 B1 9/2006 Huang et al.
7,108,556 B2 9/2006 Cohen et al.
7,156,672 B2 1/2007 Fromm et al.
7,163,421 B1 1/2007 Cohen et al.
7,232,344 B1 6/2007 Gillespie et al.
7,285,018 B2 10/2007 Kenny et al.
7,316,585 B2 1/2008 Smith et al.
7,318,740 B1 1/2008 Henry et al.
7,320,614 B2 1/2008 Toda et al.
7,322,845 B2 1/2008 Regnier et al.
7,331,822 B2 2/2008 Chen n
7,335,063 B2 2/2008 Cohen et al.
7,364,464 B2 4/2008 Iino et al.
7,371,117 B2 5/2008 Gailus
7,407,413 B2 8/2008 Minich
7,467,977 B1 12/2008 Yi et al.
7,473,124 B1 1/2009 Briant et al.
7,494,383 B2 2/2009 Cohen et al.

(56) References Cited

U.S. PATENT DOCUMENTS 7,540,781 B2 6/2009 Kenny et al.
7,581,990 B2 9/2009 Kirk et al.
7,588,464 B2 9/2009 Kim
7,604,502 B2 10/2009 Pan
7,645,165 B2 1/2010 Wu et al.
7,690,946 B2 4/2010 Knaub et al.
7,699,644 B2 4/2010 Szczesny et al.
7,722,401 B2 5/2010 Kirk et al.
7,727,027 B2 6/2010 Chiang et al.
7,727,028 B1 6/2010 Zhang et al.
7,731,537 B2 6/2010 Amleshi et al.
7,753,731 B2 7/2010 Cohen et al.
7,771,233 B2 8/2010 Gailus
7,789,676 B2 9/2010 Morgan et al.
7,794,240 B2 9/2010 Cohen et al.
7,794,278 B2 9/2010 Cohen et al.
7,806,729 B2 10/2010 Nguyen et al.
7,824,192 B2 11/2010 Lin et al.
7,871,296 B2 1/2011 Fowler et al.
7,874,873 B2 1/2011 Do et al.
7,883,369 B1 2/2011 Sun et al.
7,887,371 B2 2/2011 Kenny et al.
7,887,379 B2 2/2011 Kirk
7,906,730 B2 3/2011 Atkinson et al.
7,914,304 B2 3/2011 Cartier et al.
7,946,889 B2 5/2011 Mizumura
7,985,097 B2 7/2011 Gulla
7,993,147 B2 8/2011 Cole et al.
8,018,733 B2 9/2011 Jia
8,083,553 B2 12/2011 Manter et al.
8,123,544 B2 2/2012 Kobayashi
8,182,289 B2 5/2012 Stokoe et al.
8,215,968 B2 7/2012 Cartier et al.
8,216,001 B2 7/2012 Kirk
8,262,411 B2 9/2012 Kondo
8,272,877 B2 9/2012 Stokoe et al.
8,337,247 B2 12/2012 Zhu
8,348,701 B1 1/2013 Lan et al.
8,371,875 B2 2/2013 Gailus
8,382,524 B2 2/2013 Khilchenko et al.
8,440,637 B2 5/2013 Elmen
8,480,432 B2 7/2013 Wu
8,506,319 B2 8/2013 Ritter et al.
8,506,331 B2 8/2013 Wu
8,545,253 B2 10/2013 Amidon et al.
8,550,861 B2 10/2013 Cohen et al.
8,597,051 B2 12/2013 Yang et al.
8,657,627 B2 2/2014 McNamara et al.
8,715,003 B2 5/2014 Buck et al.
8,715,005 B2 5/2014 Pan
8,740,637 B2 6/2014 Wang et al.
8,764,492 B2 7/2014 Chiang
8,771,016 B2 7/2014 Atkinson et al.
8,864,506 B2 10/2014 Little
8,864,521 B2 10/2014 Atkinson et al.
8,905,777 B2 12/2014 Zhu et al.
8,926,377 B2 1/2015 Kirk et al.
8,944,831 B2 2/2015 Stoner et al.
8,968,034 B2 3/2015 Hsu
8,998,642 B2 4/2015 Manter et al.
9,004,942 B2 4/2015 Paniauqa
9,011,177 B2 4/2015 Lloyd et al.
9,022,806 B2 5/2015 Cartier, Jr. et al.
9,028,281 B2 5/2015 Kirk et al.
9,065,230 B2 6/2015 Milbrand, Jr.
9,124,009 B2 9/2015 Atkinson et al.
9,219,335 B2 12/2015 Atkinson et al.
9,225,085 B2 12/2015 Cartier, Jr. et al.
9,257,794 B2 2/2016 Wanha et al.
9,263,835 B2 2/2016 Guo
9,281,590 B1 3/2016 Liu et al.
9,287,668 B2 3/2016 Chen et al.
9,300,074 B2 3/2016 Gailus
9,337,585 B1 5/2016 Yang
9,350,095 B2 5/2016 Arichika et al.
9,450,344 B2 9/2016 Cartier, Jr. et al.
9,484,674 B2 11/2016 Cartier, Jr. et al.
9,509,101 B2 11/2016 Cartier, Jr. et al.
9,520,686 B2 12/2016 Hu et al.
9,520,689 B2 12/2016 Cartier, Jr. et al.
9,537,250 B2 1/2017 Kao et al.
9,640,915 B2 5/2017 Phillips
9,692,183 B2 6/2017 Phillips
9,742,132 B1 8/2017 Hsueh
9,843,135 B2 12/2017 Guetig et al.
9,935,385 B2 4/2018 Phillips et al.
9,972,945 B1 5/2018 Huang et al.
9,997,871 B2 6/2018 Zhong
10,122,129 B2 11/2018 Milbrand, Jr. et al.
10,135,197 B2 11/2018 Little et al.
10,211,577 B2 2/2019 Milbrand, Jr. et al.
10,243,304 B2 3/2019 Kirk et al.
10,270,191 B1 4/2019 Li et al.
10,276,995 B2 4/2019 Little
10,283,910 B1 * 5/2019 Chen ..... H01R 4/04
10,320,102 B2 6/2019 Phillips et al.
10,348,040 B2 7/2019 Cartier, Jr. et al.
10,381,767 B1 8/2019 Milbrand, Jr. et al.
10,431,936 B2 10/2019 Horning et al.
10,439,311 B2 10/2019 Phillips et al.
10,511,128 B2 12/2019 Kirk et al.
10,541,482 B2 1/2020 Sasame et al.
10,601,181 B2 3/2020 Lu et al.
10,777,921 B2 9/2020 Lu et al.
10,797,446 B2 10/2020 Liu et al.
10,826,214 B2 11/2020 Phillips et al.
10,833,437 B2 * 11/2020 Huang ..... H01R 12/58
10,840,622 B2 11/2020 Sasame et al.
10,965,064 B2 * 3/2021 Hsu ..... H01R 13/631
11,146,025 B2 10/2021 Lu et al.
11,189,971 B2 11/2021 Lu
11,264,755 B2 3/2022 Te
2001/0012730 A1 8/2001 Ramey et al.
2001/0042632 A1 11/2001 Manov et al.
2001/0046810 A1 11/2001 Cohen et al.
2002/0042223 A1 4/2002 Belopolsky et al.
2002/0061671 A1 5/2002 Torii
2002/0089464 A1 7/2002 Joshi
2002/0098738 A1 7/2002 Astbury et al.
2002/0111068 A1 8/2002 Cohen et al.
2002/0111069 A1 8/2002 Astbury et al.
2002/0123266 A1 9/2002 Ramey et al.
2002/0132518 A1 9/2002 Kobayashi
2002/0146926 A1 10/2002 Fogg et al.
2003/0119360 A1 6/2003 Jiang et al.
2003/0220018 A1 11/2003 Winings et al.
2004/0005815 A1 1/2004 Mizumura et al.
2004/0020674 A1 2/2004 McFadden et al.
2004/0058572 A1 3/2004 Fromm et al.
2004/0115968 A1 6/2004 Cohen
2004/0121652 A1 6/2004 Gailus
2004/0171305 A1 9/2004 McGowan et al.
2004/0196112 A1 10/2004 Welbon et al.
2004/0235352 A1 11/2004 Takemasa
2004/0259419 A1 12/2004 Payne et al.
2005/0048818 A1 3/2005 Pan
2005/0048838 A1 3/2005 Korsunsky et al.
2005/0048842 A1 3/2005 Benham et al.
2005/0070160 A1 3/2005 Cohen et al.
2005/0133245 A1 6/2005 Katsuyama et al.
2005/0176835 A1 8/2005 Kobayashi et al.
2005/0233610 A1 10/2005 Tutt et al.
2005/0283974 A1 12/2005 Richard et al.
2005/0287869 A1 12/2005 Kenny et al.
2006/0019525 A1 1/2006 Lloyd et al.
2006/0068640 A1 3/2006 Gailus
2006/0166560 A1 7/2006 Shuey et al.
2006/0255876 A1 11/2006 Kushta et al.
2006/0276082 A1 * 12/2006 Hung ..... G06K 7/0034
439/630
2006/0292932 A1 12/2006 Benham et al.
2007/0004282 A1 1/2007 Cohen et al.
2007/0004828 A1 1/2007 Khabbaz
2007/0021000 A1 1/2007 Laurx

(56) References Cited

U.S. PATENT DOCUMENTS

2007/0021001 A1 1/2007 Laurx et al.
2007/0021002 A1 1/2007 Laurx et al.
2007/0021003 A1 1/2007 Laurx et al.
2007/0021004 A1 1/2007 Laurx et al.
2007/0037419 A1 2/2007 Sparrowhawk
2007/0042639 A1 2/2007 Manter et al.
2007/0054554 A1 3/2007 Do et al.
2007/0059961 A1 3/2007 Cartier et al.
2007/0155241 A1 7/2007 Lappohn
2007/0197063 A1 8/2007 Ngo et al.
2007/0218765 A1 9/2007 Cohen et al.
2007/0243764 A1 10/2007 Liu et al.
2007/0293084 A1 12/2007 Ngo
2008/0020640 A1 1/2008 Zhang et al.
2008/0194146 A1 8/2008 Gailus
2008/0246555 A1 10/2008 Kirk et al.
2008/0248658 A1 10/2008 Cohen et al.
2008/0248659 A1 10/2008 Cohen et al.
2008/0248660 A1 10/2008 Kirk et al.
2009/0011641 A1 1/2009 Cohen et al.
2009/0011645 A1 1/2009 Laurx et al.
2009/0035955 A1 2/2009 McNamara
2009/0061661 A1 3/2009 Shuey et al.
2009/0117386 A1 5/2009 Vacant et al.
2009/0203259 A1 8/2009 Nguyen et al.
2009/0239395 A1 9/2009 Cohen et al.
2009/0258516 A1 10/2009 Hiew et al.
2009/0291593 A1 11/2009 Atkinson et al.
2009/0305530 A1 12/2009 Ito et al.
2009/0305533 A1 12/2009 Feldman et al.
2009/0305553 A1 12/2009 Thomas et al.
2010/0048058 A1 2/2010 Morgan et al.
2010/0068934 A1 3/2010 Li et al.
2010/0075538 A1 3/2010 Ohshida
2010/0081302 A1 4/2010 Atkinson et al.
2010/0112846 A1 5/2010 Kotaka
2010/0124851 A1 5/2010 Xiong et al.
2010/0144167 A1 6/2010 Fedder et al.
2010/0203772 A1 8/2010 Mao et al.
2010/0291806 A1 11/2010 Minich et al.
2010/0294530 A1 11/2010 Atkinson et al.
2011/0003509 A1 1/2011 Gailus
2011/0067237 A1 3/2011 Cohen et al.
2011/0104948 A1 5/2011 Girard, Jr. et al.
2011/0130038 A1 6/2011 Cohen et al.
2011/0143605 A1 6/2011 Pepe
2011/0212649 A1 9/2011 Stokoe et al.
2011/0212650 A1 9/2011 Amleshi et al.
2011/0230095 A1 9/2011 Atkinson et al.
2011/0230096 A1 9/2011 Atkinson et al.
2011/0256739 A1 10/2011 Toshiyuki et al.
2011/0287663 A1 11/2011 Gailus et al.
2012/0094536 A1 4/2012 Khilchenko et al.
2012/0156929 A1 6/2012 Manter et al.
2012/0184145 A1 7/2012 Zeng
2012/0184154 A1 7/2012 Frank et al.
2012/0202363 A1 8/2012 McNamara et al.
2012/0202386 A1 8/2012 McNamara et al.
2012/0214344 A1 8/2012 Cohen et al.
2013/0012038 A1 1/2013 Kirk et al.
2013/0017733 A1 1/2013 Kirk et al.
2013/0065454 A1 3/2013 Milbrand Jr.
2013/0078870 A1 3/2013 Milbrand, Jr.
2013/0078871 A1 3/2013 Milbrand, Jr.
2013/0090001 A1 4/2013 Kagotani
2013/0109232 A1 5/2013 Paniaqua
2013/0143442 A1 6/2013 Cohen et al.
2013/0196553 A1 8/2013 Gailus
2013/0217263 A1 8/2013 Pan
2013/0225006 A1 8/2013 Khilchenko et al.
2013/0237100 A1 9/2013 Affeltranger
2013/0316590 A1 11/2013 Hon
2014/0004724 A1 1/2014 Cartier, Jr. et al.
2014/0004726 A1 1/2014 Cartier, Jr. et al.
2014/0004746 A1 1/2014 Cartier, Jr. et al.
2014/0024263 A1 1/2014 Dong et al.
2014/0057498 A1 2/2014 Cohen
2014/0113487 A1 4/2014 Chen et al.
2014/0273557 A1 9/2014 Cartier, Jr. et al.
2014/0273627 A1 9/2014 Cartier, Jr. et al.
2014/0370729 A1 12/2014 Wang
2014/0377992 A1 12/2014 Chang et al.
2015/0056856 A1 2/2015 Atkinson et al.
2015/0072546 A1 3/2015 Li
2015/0099408 A1 4/2015 Myer et al.
2015/0111401 A1 4/2015 Guo
2015/0111427 A1 4/2015 Foxconn
2015/0126068 A1 5/2015 Fang
2015/0140866 A1* 5/2015 Tsai ..... H01R 12/724 439/637
2015/0214673 A1 7/2015 Gao et al.
2015/0236451 A1 8/2015 Cartier, Jr. et al.
2015/0236452 A1 8/2015 Cartier, Jr. et al.
2015/0255904 A1 9/2015 Ito
2015/0255926 A1 9/2015 Paniagua
2015/0340798 A1 11/2015 Kao et al.
2016/0149343 A1 5/2016 Atkinson et al.
2016/0268744 A1 9/2016 Little et al.
2017/0077654 A1 3/2017 Yao et al.
2017/0352970 A1 12/2017 Liang et al.
2018/0062323 A1* 3/2018 Kirk ..... H01R 13/6594
2018/0076555 A1 3/2018 Scholeno et al.
2018/0145438 A1 5/2018 Cohen
2018/0198220 A1 7/2018 Sasame et al.
2018/0205177 A1 7/2018 Zhou et al.
2018/0212376 A1 7/2018 Wang et al.
2018/0212385 A1 7/2018 Little
2018/0219331 A1 8/2018 Cartier, Jr. et al.
2018/0241156 A1 8/2018 Huang et al.
2018/0269607 A1* 9/2018 Wu ..... H01R 12/79
2018/0331444 A1 11/2018 Ono
2019/0006778 A1 1/2019 Fan et al.
2019/0044284 A1 2/2019 Dunham
2019/0052019 A1* 2/2019 Huang ..... H01R 13/6471
2019/0067854 A1* 2/2019 Ju ..... H01R 13/46
2019/0173209 A1* 6/2019 Lu ..... H01R 13/6599
2019/0173232 A1 6/2019 Lu et al.
2019/0214755 A1* 7/2019 Manickam ..... H01R 12/721
2019/0334292 A1 10/2019 Cartier, Jr. et al.
2020/0021052 A1 1/2020 Milbrand, Jr. et al.
2020/0076135 A1* 3/2020 Tang ..... H01R 12/724
2020/0153134 A1 5/2020 Sasame et al.
2020/0161811 A1* 5/2020 Lu ..... H01R 13/506
2020/0203865 A1 6/2020 Wu et al.
2020/0203867 A1 6/2020 Lu
2020/0203886 A1 6/2020 Wu et al.
2020/0235529 A1 7/2020 Kirk et al.
2020/0259294 A1 8/2020 Lu
2020/0266584 A1 8/2020 Lu
2020/0335914 A1 10/2020 Hsu et al.
2020/0358226 A1 11/2020 Lu et al.
2020/0395698 A1 12/2020 Hou et al.
2020/0403350 A1* 12/2020 Hsu ..... H01R 13/631
2021/0036452 A1 2/2021 Phillips et al.
2021/0050683 A1 2/2021 Sasame et al.
2021/0135389 A1 5/2021 Jiang
2021/0135403 A1* 5/2021 Yang ..... H01R 13/6471
2021/0135404 A1 5/2021 Jiang
2021/0203104 A1* 7/2021 Chen ..... H01R 13/405
2021/0218195 A1 7/2021 Hsu et al.
2021/0399449 A1 12/2021 Guo et al.
2022/0069496 A1 3/2022 Yi et al.

FOREIGN PATENT DOCUMENTS

CN 1275825 A 12/2000
CN 2519434 Y 10/2002
CN 1179448 C 12/2004
CN 1650479 A 8/2005
CN 1799290 A 7/2006
CN 2896615 Y 5/2007
CN 1996678 A 7/2007
CN 2930006 Y 8/2007
CN 101019277 A 8/2007

(56) References Cited

FOREIGN PATENT DOCUMENTS

| | | | |
|---|---|---|---|
| CN | 101176389 | A | 5/2008 |
| CN | 101208837 | A | 6/2008 |
| CN | 101312275 | A | 11/2008 |
| CN | 201323275 | Y | 10/2009 |
| CN | 101600293 | A | 12/2009 |
| CN | 201374434 | Y | 12/2009 |
| CN | 101752700 | A | 6/2010 |
| CN | 101790818 | A | 7/2010 |
| CN | 101120490 | B | 11/2010 |
| CN | 101926055 | A | 12/2010 |
| CN | 201846527 | U | 5/2011 |
| CN | 102106041 | A | 6/2011 |
| CN | 201868621 | U | 6/2011 |
| CN | 102195173 | A | 9/2011 |
| CN | 102224640 | A | 10/2011 |
| CN | 102232259 | A | 11/2011 |
| CN | 102239605 | A | 11/2011 |
| CN | 102292881 | A | 12/2011 |
| CN | 101600293 | B | 5/2012 |
| CN | 102456990 | A | 5/2012 |
| CN | 102487166 | A | 6/2012 |
| CN | 102593661 | A | 7/2012 |
| CN | 102598430 | A | 7/2012 |
| CN | 202395248 | U | 8/2012 |
| CN | 102694318 | A | 9/2012 |
| CN | 102738621 | A | 10/2012 |
| CN | 102859805 | A | 1/2013 |
| CN | 202695788 | U | 1/2013 |
| CN | 202695861 | U | 1/2013 |
| CN | 203445304 | U | 2/2014 |
| CN | 103840285 | A | 6/2014 |
| CN | 203690614 | U | 7/2014 |
| CN | 204030057 | U | 12/2014 |
| CN | 204167554 | U | 2/2015 |
| CN | 104409906 | A | 3/2015 |
| CN | 104577577 | A | 4/2015 |
| CN | 104659573 | A | 5/2015 |
| CN | 204349140 | U | 5/2015 |
| CN | 204577746 | U | 8/2015 |
| CN | 204696287 | U | 10/2015 |
| CN | 105633660 | A | 6/2016 |
| CN | 105703103 | A | 6/2016 |
| CN | 106099546 | A | 11/2016 |
| CN | 107069281 | A | 8/2017 |
| CN | 304240766 | S | 8/2017 |
| CN | 304245430 | S | 8/2017 |
| CN | 206712072 | U | 12/2017 |
| CN | 206712089 | U | 12/2017 |
| CN | 107706632 | A | 2/2018 |
| CN | 207677189 | U | 7/2018 |
| CN | 208078300 | U | 11/2018 |
| CN | 208209042 | U | 12/2018 |
| CN | 208797273 | U | 4/2019 |
| CN | 210326355 | U | 4/2020 |
| CN | 112072400 | A | 12/2020 |
| CN | 107706675 | B | 4/2021 |
| CN | 212874843 | U | 4/2021 |
| CN | 113517619 | A | 10/2021 |
| DE | 60216728 | T2 | 11/2007 |
| EP | 0 560 551 | A1 | 9/1993 |
| EP | 0820124 | A2 | 1/1998 |
| EP | 1 018 784 | A1 | 7/2000 |
| EP | 1 779 472 | A1 | 5/2007 |
| EP | 2 169 770 | A2 | 3/2010 |
| EP | 2 405 537 | A1 | 1/2012 |
| GB | 1049435 | A | 11/1966 |
| GB | 1272347 | A | 4/1972 |
| JP | H3-156761 | A2 | 7/1991 |
| JP | H07-302649 | A | 11/1995 |
| JP | 2001-510627 | A | 7/2001 |
| JP | 2002-151190 | A2 | 5/2002 |
| JP | 2006-344524 | A | 12/2006 |
| JP | 2010-129173 | A | 6/2010 |
| MX | 9907324 | A1 | 8/2000 |
| TW | 200835073 | A | 8/2008 |
| TW | M357771 | U | 5/2009 |
| TW | M474278 | U | 3/2014 |
| TW | 1535129 | B | 5/2016 |
| TW | M534922 | U | 1/2017 |
| TW | 1596840 | | 8/2017 |
| TW | M558481 | U | 4/2018 |
| TW | M558482 | U | 4/2018 |
| TW | M558483 | U | 4/2018 |
| TW | M559006 | U | 4/2018 |
| TW | M559007 | U | 4/2018 |
| TW | M560138 | U | 5/2018 |
| TW | M562507 | U | 6/2018 |
| TW | M565894 | Y | 8/2018 |
| TW | M565895 | Y | 8/2018 |
| TW | M565899 | Y | 8/2018 |
| TW | M565900 | Y | 8/2018 |
| TW | M565901 | Y | 8/2018 |
| TW | M605564 | U | 12/2020 |
| WO | 88/05218 | A1 | 7/1988 |
| WO | 98/35409 | A1 | 8/1998 |
| WO | 2004/059794 | A2 | 7/2004 |
| WO | 2004/059801 | A2 | 7/2004 |
| WO | 2006/039277 | A1 | 4/2006 |
| WO | 2007/005597 | A2 | 1/2007 |
| WO | 2007/005599 | A1 | 1/2007 |
| WO | 2008/124052 | A2 | 10/2008 |
| WO | 2008/124054 | A2 | 10/2008 |
| WO | 2008/124057 | A2 | 10/2008 |
| WO | 2008/124101 | A2 | 10/2008 |
| WO | 2010/030622 | A1 | 3/2010 |
| WO | 2010/039188 | A1 | 4/2010 |
| WO | 2011/100740 | A2 | 8/2011 |
| WO | 2017/007429 | A1 | 1/2017 |

OTHER PUBLICATIONS

U.S. Appl. No. 16/760,400, filed Apr. 29, 2020, Hou et al.
U.S. Appl. No. 17/085,342, filed Oct. 30, 2020, Sasame et al.
U.S. Appl. No. 17/089,905, filed Nov. 5, 2020, Jiang.
U.S. Appl. No. 17/089,934, Nov. 5, 2020, Jiang.
U.S. Appl. No. 17/216,463, filed Mar. 29, 2021, Hsu et al.
U.S. Appl. No. 17/283,511, filed Apr. 7, 2021, Guo et al.
U.S. Appl. No. 17/402,255, filed Aug. 13, 2021, Yi et al.
CN 201580014851.4, dated Sep. 4, 2019, Chinese Office Action.
CN 201580014851.4, dated Jun. 1, 2020, Chinese communication.
CN 201680051491.X, dated Apr. 30, 2019, Chinese Office Action.
CN 201780064531.9, dated Jan. 2, 2020, Chinese Office Action.
CN 201780097919.9, dated Mar. 10, 2021, Chinese Office Action.
CN 201780097919.9, dated Dec. 3, 2021 Chinese Office Action.
CN 202010031395.7, dated Jan. 18, 2021, Chinese Office Action.
EP 11166820.8, dated Jan. 24, 2012, Extended European Search Report.
EP 17930428.2, dated May 19, 2021, Extended European Search Report.
PCT/CN2017/108344, dated Aug. 1, 2018, International Search Report and Written Opinion.
PCT/CN2017/108344, dated Mar. 6, 2020, International Preliminary Report on Patentability Chapter II.
PCT/CN2018/118798, dated Jul. 18, 2019, International Search Report and Written Opinion.
PCT/CN2021/114671, dated Nov. 29, 2021, International Search Report and Written Opinion.
PCT/SG2016/050317, dated Oct. 18, 2016, International Search Report and Written Opinion.
PCT/SG2016/050317, dated Jan. 18, 2018, International Preliminary Report on Patentability.
PCT/US2005/034605, dated Jan. 26, 2006, International Search Report and Written Opinion.
PCT/US2006/025562, dated Oct. 31, 2007, International Search Report with Written Opinion.
PCT/US2010/056482, dated May 24, 2012 International Preliminary Report on Patentability.
PCT/US2010/056482, dated Mar. 14, 2011, International Search Report and Written Opinion.

(56) References Cited

OTHER PUBLICATIONS

PCT/US2011/026139, dated Sep. 7, 2012, International Preliminary Report on Patentability.
PCT/US2011/026139, dated Nov. 22, 2011, International Search Report and Written Opinion.
PCT/US2011/034747, dated Jul. 28, 2011, International Search Report and Written Opinion.
PCT/US2012/023689, dated Aug. 15, 2013, International Preliminary Report on Patentability.
PCT/US2012/033689, dated Sep. 12, 2012, International Search Report and Written Opinion.
PCT/US2012/060610, dated May 13, 2015, International Search Report and Written Opinion.
PCT/US2015/012463, dated Mar. 29, 2013, International Search Report and Written Opinion.
Chinese communication for Chinese Application No. 201580014851.4, dated Jun. 1, 2020.
Chinese Office Action dated Jan. 18, 2021 in connection with Chinese Application No. 202010031395.7.
Chinese Office Action for Application No. 201680051491.X dated Apr. 30, 2019.
Chinese Office Action for Chinese Application No. 201580014851.4 dated Sep. 4, 2019.
Chinese Office Action for Chinese Application No. 201780064531.9 dated Jan. 2, 2020.
Chinese Office Action for Chinese Application No. 201780097919.9, dated Mar. 10, 2021.
Chinese Office Action for Chinese Application No. 201780097919.9, dated Dec. 3, 2021.
Extended European Search Report dated May 19, 2021 in connection with European Application No. 17930428.2.
Extended European Search Report for European Application No. EP 11166820.8 dated Jan. 24, 2012.
International Preliminary Report on Patentability Chapter II for International Application No. PCT/CN2017/108344 dated Mar. 6, 2020.
International Preliminary Report on Patentability for International Application No. PCT/US2010/056482 dated May 24, 2012.
International Preliminary Report on Patentability for International Application No. PCT/US2011/026139 dated Sep. 7, 2012.
International Preliminary Report on Patentability for International Application No. PCT/US2012/023689 dated Aug. 15, 2013.
International Preliminary Report on Patentability for International Application No. PCT/SG2016/050317 dated Jan. 18, 2018.
International Search Report and Written Opinion for International Application No. PCT/US2010/056482 dated Mar. 14, 2011.
International Search Report and Written Opinion for International Application No. PCT/US2011/026139 dated Nov. 22, 2011.
International Search Report and Written Opinion for International Application No. PCT/US2012/023689 dated Sep. 12, 2012.
International Search Report and Written Opinion for International Application No. PCT/US2012/060610 dated Mar. 29, 2013.
International Search Report and Written Opinion for International Application No. PCT/US2015/012463 dated May 13, 2015.
International Search Report and Written Opinion for International Application No. PCT/US2017/047905 dated Dec. 4, 2017.
International Search Report and Written Opinion for International Application No. PCT/CN2017/108344 dated Aug. 1, 2018.
International Search Report and Written Opinion for International Application No. PCT/US2005/034605 dated Jan. 26, 2006.
International Search Report and Written Opinion for International Application No. PCT/US2011/034747 dated Jul. 28, 2011.
International Search Report and Written Opinion for International Application No. PCT/SG2016/050317 dated Oct. 18, 2016.
International Search Report and Written Opinion dated Jul. 18, 2019 for International Application No. PCT/CN2018/118798.
International Search Report and Written Opinion dated Nov. 29, 2021 for International Application No. PCT/CN2021/114671.
International Search Report with Written Opinion for International Application No. PCT/US2006/025562 dated Oct. 31, 2007.
[No Author Listed], Carbon Nanotubes For Electromagnetic Interference Shielding. SBIR/STTR. Award Information. Program Year 2001. Fiscal Year 2001. Materials Research Institute, LLC. Chu et al. Available at http://sbir.gov/sbirsearch/detail/225895. Last accessed Sep. 19, 2013.
[No Author Listed], High Speed Backplane Connectors. Tyco Electronics. Product Catalog No. 1773095. Revised Dec. 2008. 1-40 pages.
[No Author Listed], MCIO 124pos 85ohm. Amphenol Assembletech. 1 page. URL:http://www.amphenol-ast.com/v3/en/overview.aspx?classId=234 [retrieved on Apr. 11, 2022]
[No Author Listed], Military Fibre Channel High Speed Cable Assembly, www.gore.com. 2008. [last accessed Aug. 2, 2012 via Internet Archive: Wayback Machine http://web.archive.org] Link archived: http://www.gore.com/en.sub.—xx/products/cables/copper/networking/militar-y/military.sub.—fibre . . . Last archive date Apr. 6, 2008.
[No Author Listed], Mini Cool Edge IO—The Ideal Solution to Transmit Next Generation High-Speed Signal to Designated Area in Your System. Jul. 25, 2018. 2 pages. URL:https://www.amphenol-icc.com/connect/mini-cool-edge-io-the-ideal-solution-to-transmit-next-generation-high-speedsignal.html [retrieved on Apr. 11, 2022].
[No. Author Listed], Mini Cool Edge IO Connector. Commercial IO. Amphenol ICC. 5 pages. URL:https://cdn.amphenol-icc.com/media/wysiwyg/files/documentation/datasheet/inputoutput/io_mini_cool_edge_io.pdf [retrieved on Apr. 11, 2022].
[No Author Listed], SFF-TA-1016 Specification for Internal Unshielded High Speed Connector System. Rev 0.0.1. SNIA SFF TWG Technology Affiliate. Nov. 15, 2019. 40 pages.
Beaman, High Performance Mainframe Computer Cables. 1997 Electronic Components and Technology Conference. 1997;911-7.
Reich et al., Microwave Theory and Techniques. Boston Technical Publishers, Inc. 1965;182-91.
Shi et al. Improving Signal Integrity in Circuit Boards by Incorporating Absorbing Materials. 2001 Proceedings. 51st Electronic Components and Technology Conference, Orlando FL. 2001:1451-56.

* cited by examiner

HIGH SPEED CONNECTOR

BACKGROUND OF THE INVENTION

1. Field of the Invention

The present invention relates to high speed connectors, and more particularly, to a novel high speed connector.

2. Description of the Related Art

A high speed connector is a technique of wire junction for computer which is mainly for data transmission of peripheral components, such as an interface for equipment such as hard disks. However, it is desirable to improve the fastening stability of the connectors.

SUMMARY OF THE INVENTION

For improving the issues above, a high speed connector is disclosed. Through the structural optimization, strength of the side wall is improved, whereby the stability thereof is increased.

For achieving the aforementioned objectives, a high speed connector is provided, comprising:

a metal casing, a plastic casing, and a terminal assembly;

the metal casing comprising a main wall, a side wall, and a combination position;

the plastic casing formed in a cuboid shape and comprising a front connection portion and a cover body, wherein the front connection portion and the cover body are connected to each other; the front connection portion comprising an engagement member; the cover body comprising a protrusion and a terminal engagement slot;

the main wall comprising an engagement bore disposed on the main wall;

the side wall disposed on two sides of the main wall;

the combination portion formed on a junction between the main wall and the side wall;

the front connection portion and the terminal engagement slot being disposed in the cover body and on a lateral side of the cover body, respectively;

the engagement member disposed on a lateral side of the front connection portion;

the protrusion disposed on an insertion end of a junction of the cover body;

when the metal casing being engaged with an outer side of the plastic casing, the engagement member being engaged in the engagement bore, and the protrusion being engaged in the combination position;

the terminal assembly being inserted in the front connection portion and comprising an upper terminal and a lower terminal; and the upper terminal and the lower terminal comprising a metal pin and a plastic strip.

Preferably, the upper terminal related to the high speed connector comprises a bolt strip; the bolt strip being disposed on a later side of the upper terminal and comprising a bolt body; the bolt body disposed on the other end portion of the bolt strip connecting the upper terminal. When the upper terminal is inserted in the front connection portion, the bolt body is pressed by the terminal engagement slot to deform, so as to be placed into the terminal engagement slot, and subsequently restored to the original bolt body shape and fitted in the terminal engagement slot. Therefore, the bolt strip is fastened in the terminal engagement slot.

Preferably, the side wall related to the high speed connector comprises a foot; the foot being disposed on one side of the side wall which is connected with a PCB (printed circuit board); the foot being formed in a straight foot type or a patch type; the straight foot type foot presented in a straight plate shape, the patch type foot presented in a curve body.

Preferably, the terminal assembly related to the high speed connector comprises an engagement stud and an engagement slot; the engagement stud disposed on the lower terminal; the engagement slot disposed on the upper terminal; the upper terminal and the lower terminal being engaged through the engagement stud and the engagement slot.

With such configuration, the present invention achieves following advantages. Compared to prior arts, the high speed connector of the present invention is structurally optimized, wherein the strength of the side wall of thereof is improved, so as to increase the stability thereof. The metal casing of the SlimLine SAS connector engages and wraps the plastic casing for increasing the general strength. The metal casing is formed by stamping and riveting, so that the seam thereon is integrally combined. Regarding the upper and lower metal terminals, the plastic strip is embedded between the metal pin through insert injection.

DETAILED DESCRIPTION OF THE INVENTION

The aforementioned and further advantages and features of the present invention will be understood by reference to the description of the preferred embodiment in conjunction with the accompanying drawings where the components are illustrated based on a proportion for explanation but not subject to the actual component proportion.

Embodiment 1

Figure 1:
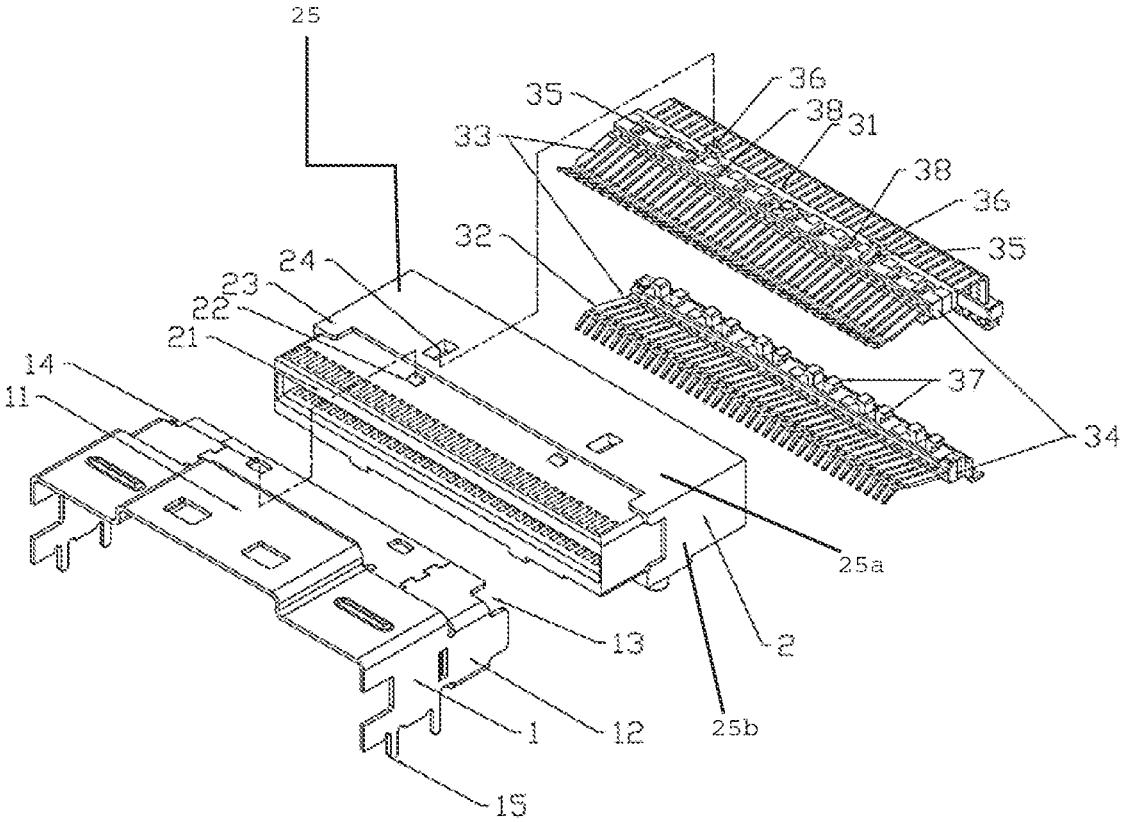
FIG. 1 is an exploded view of the high speed connector.

Referring to FIG. 1, a high speed connector is provided, comprising a metal casing 1, a plastic casing 2, and a terminal assembly 3.

The metal casing 1 comprises a main wall 11, a side wall 12, and a combination position 13.

The plastic casing 2 is formed in a cuboid shape and comprising a front connection portion 21 and a cover body 25, wherein the front connection portion 21 and the cover body 25 are connected to each other. The front connection portion 21 comprises an engagement member 22. The cover body 25 comprises a protrusion 23 and a terminal engagement slot 24.

The main wall 11 comprises an engagement bore 14 disposed on the main wall 11.

The side wall 12 is disposed on two sides of the main wall 11.

The combination portion 13 is formed on a junction between the main wall 11 and the side wall 12.

The front connection portion 21 and the terminal engagement slot 24 are disposed in the cover body 25 and on a lateral side 25*a* of the cover body 25, respectively. The cover body 25 comprises transitional sides 25*b* extending perpendicular to the lateral side 25*a*.

The engagement member 22 is disposed on a lateral side of the front connection portion 21.

The protrusion 23 is disposed on an insertion end of a junction of the cover body 25.

When the metal casing 1 is engaged with an outer side of the plastic casing 2, the engagement member 22 is engaged in the engagement bore 14, and the protrusion 23 is engaged in the combination position 13.

The terminal assembly 3 is inserted in the front connection portion 21 and comprises an upper terminal 31 and a lower terminal 32.

The upper terminal 31 and the lower terminal 32 comprise a metal pin 33 and a plastic strip 34.

Embodiment 2

Referring to FIG. 1, on the basis of embodiment 1, the upper terminal 31 related to the high speed connector comprises a bolt strip 35. The bolt strip 35 is disposed on a lateral side of the upper terminal 31 and comprises a bolt body 36. The bolt body 36 is disposed on the other end portion of the bolt strip 35 connecting the upper terminal 31. When the upper terminal 31 is inserted in the front connection portion 21, the bolt body 36 is pressed by the terminal engagement slot 24 to deform, so as to be placed into the terminal engagement slot 24, and subsequently restored to the original bolt body shape and fitted in the terminal engagement slot 24. Therefore, the bolt strip 35 is fastened in the terminal engagement slot 24.

Embodiment 3

Figure 2:
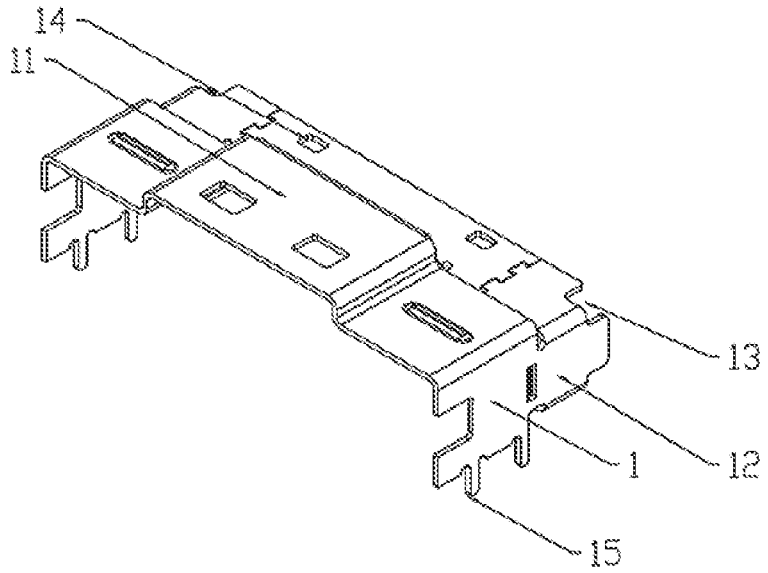
FIG. 2 is a schematic view illustrating the straight foot type metal casing of the SlimLine SAS connector.
Figure 3:
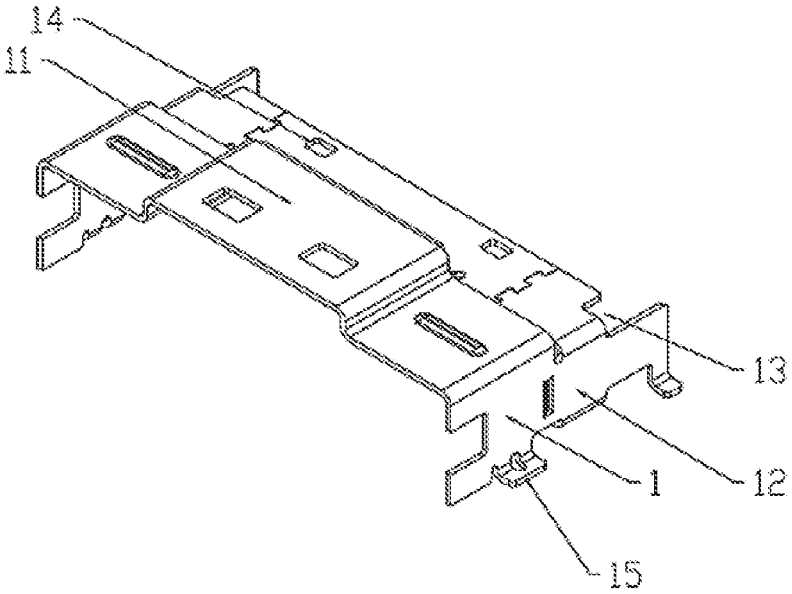
FIG. 3 is a schematic view illustrating the patch type metal casing of the SlimLine SAS connector.

Referring to FIG. 2 and FIG. 3, on the basis of such embodiments, the side wall 12 related to the high speed connector comprises a foot 15. The foot 15 is disposed on one side of the side wall 12 which is connected with a PCB, and the foot is formed in a straight foot type or a patch type.

The straight foot type foot 15 is presented in a straight plate shape.

The patch type foot 15 is presented in a curve body.

Embodiment 4

Referring to FIG. 1, on the basis of such embodiments, the terminal assembly 3 related to the high speed connector comprises an engagement stud 37 and an engagement slot 38. The engagement stud 37 is disposed on the lower terminal 32. The engagement slot 38 is disposed on the upper terminal 31. The upper terminal 31 and the lower terminal 32 are engaged through the engagement stud 37 and the engagement slot 38.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A connector, comprising:

a metal casing comprising a main wall comprising an engagement bore, a side wall on a side of the main wall, and a combination position adjacent a junction of the main wall and the side wall;

a plastic casing comprising a cover body comprising a protrusion adjacent an insertion end of a junction of the cover body and a terminal engagement slot on a lateral side of the cover body, and a front connection portion disposed in the cover body and connected to the cover body, the front connection portion comprising an engagement member on a lateral side of the front connection portion; and a terminal assembly disposed in the front connection portion, wherein:

the metal casing engages an outer side of the plastic casing, the engagement member engages the engagement bore, and the protrusion engages the combination position.

2. The connector of claim 1, wherein:

the terminal assembly comprises an upper terminal assembly comprising a bolt strip on a lateral side of the upper terminal assembly, the bolt strip comprising a bolt body; and the bolt body is fitted in the terminal engagement slot.

3. The connector of claim 1, wherein:

the side wall comprises a foot on one side of the side wall and configured to connect with a PCB; and the foot comprises a straight plate or a curved body.

4. The connector of claim 1, wherein:

the terminal assembly comprises an upper terminal assembly comprising an engagement stud and a lower terminal assembly comprising an engagement slot; and the upper terminal assembly and the lower terminal assembly engage each other through the engagement stud and the engagement slot.

5. A connector, comprising:

an insulative housing comprising a body and a front portion connected to each other, the body comprising a lateral side, a transitional side extending perpendicular to the lateral side, and a protrusion comprising a portion extending from the lateral side and a portion extending from the transitional side;

a terminal assembly comprising a plurality of metal pins and fixed in the insulative housing;

and a metal shell comprising a main wall and a side wall extending from a side of the main wall, and an opening extending from the main wall to the side wall, wherein the protrusion of the insulative housing engages the opening of the metal shell, such that the metal shell is restrained from moving upward, downward, leftward or rightward relative to the insulative housing.

6. The connector of claim 5, wherein:

the main wall of the metal shell comprises an opening, the front portion of the insulative housing comprises a lateral side comprising a member, and the member of the front portion of the insulative housing engages the opening of the main wall of the metal shell.

7. The connector of claim 5, wherein:

the transitional side of the body of the insulative housing is a first transitional side, the protrusion of the body of the insulative housing is a first protrusion comprising the portion extending from the lateral side and the portion extending from the first transitional side, the body of the insulative housing comprises a second transitional side extending perpendicular to the lateral side, the first transitional side and the second transitional side are on opposite sides of the lateral side, and the body of the insulative housing comprises a second protrusion comprising a portion extending from the lateral side and a portion extending from the second transitional side.

8. The connector of claim 7, wherein:

the side wall of the metal shell is a first side wall, the opening of the metal shell is a first opening extending from the main wall to the first side wall, the metal shell comprises a second side wall extending from a side of the main wall that is opposite to the side the first side wall extends, the metal shell comprises a second opening extending from the main wall to the second side wall, and the second protrusion of the insulative housing engages the second opening of the metal shell.

9. The connector of claim 5, wherein:

the portion of the protrusion extending from the lateral side and the portion of the protrusion extending from the transitional side are connected.

10. The connector of claim 7, wherein:

the portion of the second protrusion extending from the lateral side and the portion of the second protrusion extending from the second transitional side are connected.

11. The connector of claim 5, wherein the lateral side of the body of the insulative housing comprises a pair of slots, the terminal assembly comprises a bolt strip holding the plurality of metal pins, the bolt strip comprising a pair of bolt bodies, and the pair of bolt bodies of the terminal assembly are fitted in the pair of slots of the insulative housing.

12. The connector of claim 8, wherein the lateral side of the body of the insulative housing comprises a pair of slots, the terminal assembly comprises a bolt strip holding the plurality of metal pins, the bolt strip comprising a pair of bolt bodies, and the pair of bolt bodies of the terminal assembly are fitted in the pair of slots of the insulative housing, respectively.

13. A connector, comprising:

an insulative housing comprising a body and a front portion connected to each other, the body comprising a lateral side, a transitional side extending perpendicular to the lateral side, the lateral side comprising a slot, and a protrusion extending from the lateral side and the transitional side;

a metal shell fixed to the insulative housing, the metal shell comprising a main wall, a side wall, and an opening extending from the main wall to the side wall; and a terminal assembly comprising a plurality of metal pins, and a bolt strip holding the plurality of metal pins, the bolt strip comprising a bolt body, wherein the bolt body of the terminal assembly is fitted in the slot of the insulative housing, and the protrusion of the insulative housing engages the opening of the metal shell.

14. The connector of claim 13, wherein:

the bolt body of the bolt strip of the terminal assembly is deformable.

15. The connector of claim 13, wherein:

the plurality of metal pins of the terminal assembly is a first plurality of metal pins, the bolt strip holding the first plurality of metal pins is a first bolt strip, the first bolt strip comprises the bolt body fitted in the slot of the insulative housing, and the terminal assembly comprises a second plurality of metal pins held by a second bolt strip.

16. The connector of claim 15, wherein:

the first bolt strip comprises a plurality of slots, the second bolt strip comprises a plurality of studs, and the studs of the second bolt strip engage the slots of the first bolt strip.

17. The connector of claim 13, wherein:

the slot of the lateral side of the body of the insulative housing is a pair of slots, the bolt body of the bolt strip of the terminal assembly is a pair of bolt bodies, and the pair of bolt bodies are fitted in the pair of slots, respectively.

18. The connector of claim 17, wherein:

the pair of bolt bodies of the bolt strip of the terminal assembly are deformable.

19. The connector of claim 13, wherein:

the protrusion of the body of the insulative housing is a pair of protrusions, each extending from the lateral side and one of two transitional sides of the body of the insulative housing, the opening of the metal shell is a pair of openings, each extending from the main wall to one of two side walls of the metal shell, and the pair of protrusions of the insulative housing engage the pair of openings of the metal shell.

20. The connector of claim 13, wherein:

the main wall of the metal shell comprises a pair of openings, the front portion of the insulative housing comprises a lateral side comprising a pair of members, and the pair of members of the front portion of the insulative housing engages the pair of openings of the main wall of the metal shell.

* * * * *